US009048071B2

(12) United States Patent
Satoh

(10) Patent No.: US 9,048,071 B2
(45) Date of Patent: Jun. 2, 2015

(54) IMAGING MASS SPECTROMETER AND METHOD OF CONTROLLING SAME

(71) Applicant: JEOL Ltd., Tokyo (JP)

(72) Inventor: Takaya Satoh, Tokyo (JP)

(73) Assignee: JEOL Ltd., Tokyo (JP)

( * ) Notice: Subject to any disclaimer, the term of this patent is extended or adjusted under 35 U.S.C. 154(b) by 0 days.

(21) Appl. No.: 14/025,317

(22) Filed: Sep. 12, 2013

(65) Prior Publication Data

US 2014/0166874 A1 Jun. 19, 2014

(30) Foreign Application Priority Data

Sep. 14, 2012 (JP) ..... 2012-202793

(51) Int. Cl.

| | |
|---|---|
| ***H01J 49/40*** | (2006.01) |
| ***H01J 49/04*** | (2006.01) |
| ***H01J 49/00*** | (2006.01) |
| ***H01J 49/02*** | (2006.01) |
| ***H01J 49/06*** | (2006.01) |

(52) U.S. Cl.

CPC ..... *H01J 49/0004* (2013.01); *H01J 49/40* (2013.01); *H01J 49/0031* (2013.01); *H01J 49/022* (2013.01); *H01J 49/067* (2013.01)

(58) Field of Classification Search

CPC ..... H01J 49/02; H01J 49/04; H01J 49/0459; H01J 49/049; H01J 49/06; H01J 49/067; H01J 49/40; H01J 49/403

USPC ..... 250/281–283, 286–288

See application file for complete search history.

(56) References Cited

U.S. PATENT DOCUMENTS

| | | | | |
|---|---|---|---|---|
| 5,969,348 | A * | 10/1999 | Franzen | 250/282 |
| 6,518,568 | B1 * | 2/2003 | Kovtoun et al. | 250/287 |
| 2002/0027194 | A1 * | 3/2002 | Holle et al. | 250/287 |
| 2005/0023452 | A1 * | 2/2005 | Hashimoto et al. | 250/281 |

(Continued)

FOREIGN PATENT DOCUMENTS

JP 2007157353 A 6/2007

OTHER PUBLICATIONS

Toyoda et al., "Multi-turn time-of-flight mass spectrometers with electrostatic sectors", Journal of Mass Spectrometry, 2003, pp. 1125-1142, 38.

Caprioli et al., "Molecular Imaging of Biological Samples: Localization of Peptides and Proteins Using MALDI-TOF MS", Anal. Chem., 1997, pp. 4751-4760, 69.

(Continued)

*Primary Examiner* — Nicole Ippolito
*Assistant Examiner* — David E Smith
(74) *Attorney, Agent, or Firm* — The Webb Law Firm

(57) ABSTRACT

An imaging mass spectrometer capable of reducing the dependence of the resolution of a projection image on mass is offered. Also, a method of controlling this spectrometer is offered. The imaging mass spectrometer includes: a plate on which a sample is placed; a lens system through which ions generated by irradiating the sample with laser light pass; an ion optical system for separating the ions according to flight time corresponding to mass-to-charge ratio; a detection system for measuring arrival positions and flight times of the ions passed through the ion optical system and generating an image of the sample when it is ionized; and a voltage control portion for sweeping the voltage applied to an electrode included in the lens system such that the lens effect of the lens system increases with time during a given period synchronized with the laser irradiation.

11 Claims, 8 Drawing Sheets

(56) References Cited

U.S. PATENT DOCUMENTS

| | | | | |
|---|---|---|---|---|
| 2007/0114387 | A1* | 5/2007 | Chang et al. | 250/288 |
| 2008/0296488 | A1* | 12/2008 | Holle | 250/283 |
| 2011/0139973 | A1* | 6/2011 | Bowdler | 250/252.1 |
| 2011/0215239 | A1* | 9/2011 | Yamaguchi | 250/287 |

OTHER PUBLICATIONS

Luxembourg et al., "High-Spatial Resolution Mass Spectrometric Imaging of Peptide and Protein Distributions on a Surface", Anal. Chem., 2004, pp. 5339-5344, 76.

* cited by examiner

IMAGING MASS SPECTROMETER AND METHOD OF CONTROLLING SAME

CROSS-REFERENCE TO RELATED APPLICATION

This application claims priority to Japanese Patent Application No. 2012-202793, filed Sep. 14, 2012, the disclosure of which is hereby incorporated in its entirety by reference.

BACKGROUND OF THE INVENTION

1. Field of the Invention

The present invention relates to an imaging mass spectrometer used to analyze the positions and intensity distributions of trace compounds and also to a method of controlling this spectrometer.

2. Description of the Related Art

A time-of-flight (TOF) mass spectrometer is an instrument for giving a certain amount of energy to ions such that they are accelerated and travel and for finding the mass-to-charge ratios (m/z) of the ions from the times taken for the ions to reach the detector. In the TOF mass spectrometer, the ions are accelerated by a constant pulsed voltage $V_a$. At this time, from the law of conservation of energy, the following Eq. (1) holds.

$$\frac{mv^2}{2} = zeV_a \tag{1}$$

where v is the velocity of the ion, m is the mass of the ion, z is the valence number of the ion, and e is the elementary charge.

From Eq. (1), the velocity v of the ion is given by $$v = \sqrt{\frac{2zeV_a}{m}} \tag{2}$$

Therefore, the flight time T required for the ion to reach a detector, placed behind at a given distance of L, is given by $$T = \frac{L}{v} = L\sqrt{\frac{m}{2zeV_a}} \tag{3}$$

As can be seen from Eq. (3), the flight time T differs according to ink of each ion. TOFMS is an instrument for separating masses employing this principle.

The mass resolution R of a TOF mass spectrometer is defined as follows:

$$R = \frac{T}{2\Delta T} \tag{4}$$

where T is the total flight time and ΔT is a peak width.

That is, if the peak width ΔT is made constant and the total flight time T can be lengthened, the mass resolution can be improved.

The simplest ion optical system for performing mass separation is a linear TOFMS in which ions accelerated by an ion source are made to travel linearly. Also, reflectron TOFMS instruments capable of elongating the flight time by placing a reflectron field between an ion source and a detector have enjoyed wide acceptance. In the linear or reflectron type TOFMS, increasing the total flight time T (i.e., increasing the total flight distance) will lead directly to an increase in instrumental size. A multi-pass time-of-flight mass spectrometer has been developed to realize high mass resolution while avoiding an increase in instrumental size (non-patent document 1). This instrument uses four toroidal electric fields each consisting of a combination of a cylindrical electric field and a Matsuda plate. The total flight time T can be lengthened by accomplishing multiple turns in an 8-shaped circulating orbit. In this multi-pass time-of-flight mass spectrometer of non-patent document 1, positions, angles, and the distribution of kinetic energies can be maintained constant during each revolution.

One ion source for TOFMS makes use of a laser desorption/ionization (LDI) method consisting of irradiating a sample applied on a plate or a sample in the form of a solid with laser radiation to ionize the compound to be investigated. In the laser desorption/ionization method, the ionization efficiency is low in many cases depending on subjects of measurement. Therefore, the matrix-assisted laser desorption/ionization (MALDI) method is widely used. In particular, a sample is mixed and dissolved in a matrix (liquid, crystalline compound, metal powder, or the like), which has an absorption band in the used laser light wavelength and promotes ionization, is solidified, and the matrix is irradiated with laser radiation to vaporize or ionize the sample. In recent years, studies of surface-assisted laser desorption/ionization (SALDI) using a plate on which a nanostructured layer is formed to promote ionization have been in progress.

In the initial state of a laser assisted ionization typified by a MALDI method, ions or neutral particles are ejected explosively at speeds comparable to the sonic speed. Therefore, when ions are generated, large energies are distributed at the beginning. To converge this distribution towards the axis of flight, delayed extraction is used in most cases. This method consists of applying a pulsed voltage with a delay of hundreds of nsec since laser irradiation. Adoption of delayed extraction has improved the performance of MALDI-TOFMS greatly.

A technique for obtaining two-dimensional positional information, information about the masses of compounds contained at each position, and information about their abundances using a mass spectrometer is known as imaging mass spectrometry (IMS) (non-patent document 2). In one ionization method, laser desorption ionization typified by a MALDI method is used. In another ionization method known as TOF-SIMS, fast particles are employed.

One method which is based on imaging mass spectrometry (IMS) employing a MALDI technique and which obtains positional information is scanning IMS (non-patent document 2). Another method is a stigmatic IMS (non-patent document 3). In scanning imaging mass spectrometry, a mass spectrum is collected from each location while scanning the irradiation position. Mass spectra are obtained in the same way as in normal mass analysis methods. In the case of the scanning imaging mass spectrometry (IMS), the limit of the positional resolution is about the diameter of the irradiated spot, i.e., on the order of 10 μm.

On the other hand, in a stigmatic imaging mass spectrometry (IMS) technique, each ion is made to reach the detector while maintaining information about the positions at which the ions are ionized within a region irradiated with laser light. Therefore, the diameter of the spot irradiated with the laser light does not limit the positional resolution, unlike scanning IMS. However, mass separation needs to be done while preventing distortion of the positional information. Therefore, TOFMS is utilized in the mass analyzer. Furthermore, the operation is different from general MALDI-TOFMS. In normal MALDI-TOFMS, ions arriving at the detection surface at regular intervals of time are collected by the detection system and a mass spectrum is created. In the case of stigmatic imaging mass spectrometry, however, it is necessary to obtain a projection image. Therefore, acquisition of information about arrival positions on the detection surface is necessary, in addition to execution of time separation. Consequently, a detection system capable of position separation is required, in addition to time separation. Another great difference is that delayed extraction generally used in normal MALDI-TOFMS cannot be used. In delayed extraction, during laser irradiation (i.e., during ionization), ions are made to travel freely in a free space. After a lapse of hundreds of ns, a pulsed voltage is applied to accelerate the ions. As a result, the ions having a distribution of initial velocities can be detected at the same time on the detection surface. In the case of the stigmatic IMS, however, it is important to hold the ionization position information and so it is necessary to extract ions with a high voltage immediately after the laser irradiation. This makes it impossible to observe ions having a distribution of initial velocities at the same time at the detection surface. Consequently, the mass resolution tends to be lower than in scanning IMS. A technique for providing improved mass resolution by employing multi-turn TOFMS in the stigmatic IMS has been also proposed (patent document 1).

CITATION LIST

Patent Documents

Patent document 1: JP-A-2007-157353

Non-Patent Documents

Non-patent document 1: M. Toyoda, D. Okumura, M. Ishihara and I. Katakuse, J. Mass Spectrom., 2003, 38, pp. 1125-1142.

Non-patent document 2: R. M. Caprioli, T. B. Farmer, and J. Gile. Anal. Chem., 69, 4751 (1997).

Non-patent document 3: S. L. Luxembourg. T. H. Mize, L. A. McDonnell, and R. M. A. Heeren. Anal. Chem., 76, 5339 (2004).

In stigmatic imaging mass spectrometry (IMS), it is necessary to hold information about the positions of ions generated by laser irradiation. Therefore, the ions need to be extracted with a high electric field from the beginning of ionization. The lens system for magnifying the image in order to obtain information about the positions on the detection surface at which ionization is done consists of electrodes each having a hole permitting passage of ions. FIG. 8 shows the structure of the ion accelerating portion (ion source) of a stigmatic IMS using a linear TOFMS. The ion accelerating portion is rotationally symmetric with respect to the X-axis extending in the direction of flight and has two lens assemblies located near the extraction electrode and near an Einzel electrode, respectively. The lens assembly located near the extraction electrode contributes greatly to magnification of the projection image.

In the stigmatic IMS, a detection plane where position separation and time separation can be done was set at a position spaced 1,200 mm from the plate along the X-axis. From a position with Y=+0.003 mm, 3000 ions were produced at random at an initial velocity VX along the X-direction and an initial velocity VY along the Y-direction within a range between +300 and +500 m/s and between −400 and +400 m/s. The ion trajectory was simulated. The positional resolution was evaluated from the positional distribution on the detection plane. The plate voltage, extraction electrode voltage, and Einzel electrode voltage which were adjusted to be 20,000 V, 19,412 V, and 1,400 V, respectively, yielded the highest positional resolution of ions with a mass-to-charge ratio m/z of 800. FIG. 9 shows spatial distributions of ion packets with m/z of 400, 800, 1200, and 1600 on the detection surface under this condition. As can be seen from FIG. 9, the ion packet of optimized m/z of 800 is distributed in a narrow range near −0.12 mm. Since ions with an ionization position Y=+0.003 mm reached detector position Y=−0.12 mm, the magnification ratio was about 40 times. However, it is seen that the arrival positions of ions with m/z of 400, 1200, and 1600 are distributed more widely with going away from an m/z value of 800. This shows that moving away from the optimum m/z value lowers the positional resolution. This is a feature of laser desorption ionization, because initial kinetic energy differs according to mass on account of an initial velocity distribution not dependent on mass. Incidentally, only the extraction electrode voltage was adjusted to search for optimum voltage values for m/z of 400 and 1600. The results were 19,407 V and 19,419 V. In this way, the stigmatic IMS has the problem that the resolution of the projection image depends heavily on mass.

SUMMARY OF THE INVENTION

In view of the foregoing problem, the present invention has been made. According to some embodiments of the present invention, an imaging mass spectrometer capable of reducing the dependence of the resolution of a projection image on mass and a method of controlling this mass spectrometer can be offered.

(1) An imaging mass spectrometer associated with the present invention has: a plate on which a sample is placed; at least one lens system through which ions generated by irradiating the sample with laser light pass; an ion optical system for separating the ions according to flight time corresponding to mass-to-charge ratio; a detection system for measuring arrival positions and flight times of the ions passed through the ion optical system and generating an image of the sample when it is ionized; and a voltage control portion for sweeping the voltage applied to an electrode included in the lens system such that the lens effect of the lens system contributing to the magnification ratio of the image increases with the elapse of time during a given period synchronized with the laser irradiation.

Generally, ions having larger mass-to-charge ratios have larger initial kinetic energies when they are created on the plate. Also, they move away from the plate in longer times. Therefore, ions with larger m/z enter the lens system contributing to the magnification ratio of the image with larger kinetic energies with larger delays. Therefore, according to the imaging mass spectrometer associated with the present invention, the lens effect of the lens system contributing to the magnification ratio of the image is increased with the elapse of time in synchronism with the laser irradiation. Consequently, the ions can be focused uniformly irrespective of their mass-to-charge ratio. This can reduce the dependence of the resolution of the projection image on mass.

(2) In one feature of this imaging mass spectrometer associated with the present invention, the lens system contributing to the magnification ratio of the image may contain the plate, an acceleration portion terminal electrode, and an extraction electrode positioned between the plate and the acceleration portion terminal electrode.

(3) In another feature of this imaging mass spectrometer associated with the present invention, the voltage control portion may maintain constant the voltage applied to the plate and sweep the voltage applied to the extraction electrode during the given period.

According to this imaging mass spectrometer associated with the present invention, the potential difference between the plate and the extraction electrode and the potential difference between the extraction electrode and the accelerating portion terminal electrode can be varied with the elapse of time by maintaining constant the voltage on the plate and sweeping the voltage on the extraction electrode. As a result, the lens effect can be varied with the elapse of time.

(4) In a further feature of this imaging mass spectrometer associated with the present invention, the voltage control portion may maintain constant the voltage applied to the extraction electrode and sweep the voltage applied to the plate during the given period.

According to this imaging mass spectrometer associated with the present invention, the potential difference between the plate and the extraction electrode can be varied with the elapse of time while maintaining constant the potential difference between the extraction electrode and the accelerating portion terminal electrode by maintaining constant the voltage on the extraction electrode and sweeping the voltage on the plate. As a consequence, the lens effect can be varied with the elapse of time.

(5) In an additional feature of this imaging mass spectrometer associated with the present invention, the voltage control portion may sweep both the voltage applied to the plate and the voltage applied to the extraction electrode during the given period.

According to this imaging mass spectrometer associated with the present invention, the potential difference between the plate and the extraction electrode and the potential difference between the extraction electrode and the accelerating portion terminal electrode can be varied with the elapse of time by sweeping the voltage on the plate and the voltage on the extraction electrode at the same time. Consequently, the lens effect can be varied with the elapse of time.

(6) In a yet other feature of this imaging mass spectrometer associated with the present invention, the voltage control portion may sweep at least one of the applied voltages such that the ratio $|V_0-V_1|/|V_1-V_2|$ decreases with the elapse of time during the given period, where $V_0$ is the voltage on the plate, $V_1$ is the voltage on the extraction electrode, and $V_2$ is the voltage on the accelerating portion terminal electrode.

According to this imaging mass spectrometer associated with the present invention, the lens effect can be increased with the elapse of time.

(7) In an additional feature of this imaging mass spectrometer associated with the invention, the voltage control portion may vary the given period and the range of the swept voltage according to a setting of the range of mass-to-charge ratios of the ions to be measured.

According to this imaging mass spectrometer associated with the present invention, the positional resolution of the detection system can be improved by appropriately varying the sweep time for the lens system and the range in which the voltage is varied according to the range of mass-to-charge ratios of ions to be measured. In consequence, a projection image of high resolution can be obtained.

(8) In a still additional feature of this imaging mass spectrometer associated with the present invention, the ions may be generated by mixing a matrix for promoting ionization of the sample in the sample to thereby form a mixture, dripping the mixture onto the plate, and irradiating the drips of the mixture with the laser light.

(9) In a yet additional feature of this imaging mass spectrometer associated with the present invention, the plate may have a nanostructured layer for promoting ionization of the sample. The ions may be generated by dripping the sample onto the nanostructured layer of the plate and irradiating the drips of the sample with the laser light.

(10) In a still other feature of this imaging mass spectrometer associated with the present invention, the ion optical system may form an electric field that makes an image obtained whenever the ions travel a given distance analogous with the image produced when the ions are generated.

According to this imaging mass spectrometer associated with the present invention, the flight time of the ions can be lengthened and so the time resolution (mass resolution) of the detection system can be improved.

(11) In a still further feature of this imaging mass spectrometer associated with the present invention, the ion optical system may contain at least one electric sector.

(12) The present invention also provides a method of controlling an imaging mass spectrometer having: a plate on which a sample is placed; at least one lens system through which ions generated by irradiating the sample with laser light pass; an ion optical system for separating the ions according to flight time corresponding to mass-to-charge ratio; and a detection system for measuring arrival positions and flight times of the ions passed through the ion optical system and generating an image of the sample when it is ionized. The method comprises the step of sweeping the voltage applied to an electrode included in the lens system such that the lens effect of the lens system contributing to the magnification ratio of the image increases with the elapse of time during a given period synchronized with the laser irradiation.

Other features and advantages of the present invention will become apparent from the following more detailed description, taken in conjunction with the accompanying drawings, which illustrate, by way of example, the principles of the invention.

DETAILED DESCRIPTION OF THE INVENTION

The preferred embodiments of the present invention are hereinafter described in detail with reference with the drawings. It is to be understood that the embodiments described below do not unduly restrict the content of the present invention set forth in the appended claims and that configurations described below are not always constituent components of the invention.

1. First Embodiment

Figure 1:
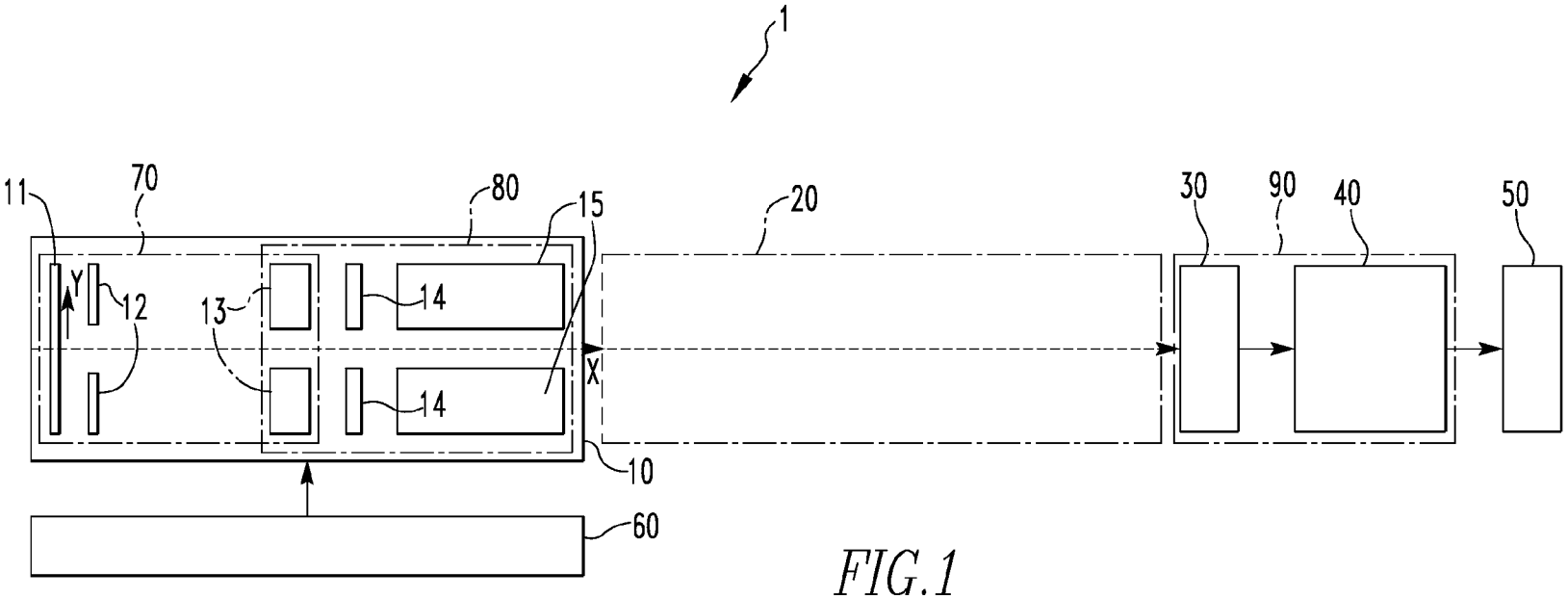
FIG. 1 is a diagram of an imaging mass spectrometer according to a first embodiment of the present invention, showing one example of configuration of the spectrometer.

FIG. 1 shows an imaging mass spectrometer according to a first embodiment of the present invention, showing one example of configuration of the spectrometer. This imaging mass spectrometer is generally indicated by reference numeral 1, and is a stigmatic imaging mass spectrometer. As shown in FIG. 1, this spectrometer 1 is configured including an ion source 10, a mass analyzer 20, a detector 30, a data processing portion 40, a display portion 50, and a voltage control portion 60. Some of the constituent elements of the imaging mass spectrometer of the present embodiment may be omitted or modified. Alternatively, new constituent elements may be added to the spectrometer.

In the present embodiment, the ion source 10 is configured including a plate 11, an extraction electrode 12, an accelerating portion terminal electrode 13, an Einzel electrode 14, and a ground electrode 15. A sample placed on the plate 11 is ionized by irradiating the sample with laser light. The method of ionizing the sample may be a matrix-assisted laser desorption/ionization (MALDI) method consisting, for example, of mixing together the sample and a matrix (liquid, crystalline compound, metal powder, or the like) for promoting ionization of the sample, dripping the mixture onto the plate 11, and irradiating the drips of the mixture with laser light to ionize the sample. Alternatively, the method of ionizing the sample may be a surface-assisted laser desorption/ionization (SALDI) method consisting, for example, of using the plate 11 having a nanostructured layer for promoting ionization of the sample, dripping the sample onto the nanostructured layer of the plate 11, and irradiating the drips of the sample with laser light.

In the present embodiment, each of the extraction electrode 12, accelerating portion terminal electrode 13, Einzel electrode 14, and ground electrode 15 is a disklike or cylindrical electrode centrally provided with a hole. Ions generated on the plate 11 pass through the central holes of the electrodes.

In particular, the ions generated on the plate 11 are first accelerated by the potential difference between the plate 11 and the extraction electrode 12 and then further accelerated by the potential difference between the extraction electrode 12 and the accelerating portion terminal electrode 13. The plate 11, extraction electrode 12, and accelerating portion terminal electrode 13 together constitute a lens system 70. Spread of the ions in the direction of travel is suppressed by the lens effect exerted according to the potential difference between the plate 11 and the extraction electrode 12 and according to the potential difference between the extraction electrode 12 and the accelerating portion terminal electrode 13. Preferably, the potential difference between the plate 11 and the accelerating portion terminal electrode 13 is increased to a maximum to enhance the efficiency at which the ions generated on the plate 11 are extracted.

The ions passed through the accelerating portion terminal electrode 13 are slightly decelerated by the potential difference between the accelerating portion terminal electrode 13 and the Einzel electrode 14 and pass through the ground electrode 15. The accelerating portion terminal electrode 13, Einzel electrode 14, and ground electrode 15 together constitute another lens system 80. Spread of the ions in the direction of travel is further suppressed by the lens effect exerted according to the potential difference between the accelerating portion terminal electrode 13 and the Einzel electrode 14 and according to the potential difference between the Einzel electrode 14 and the ground electrode 15.

Figure 2A:
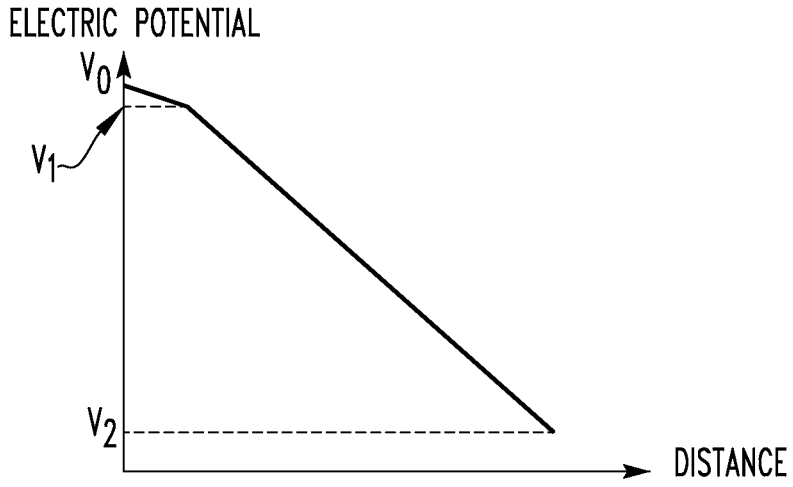
FIG. 2A is a graph showing the relation between the voltage applied to each electrode of a lens system according to the first embodiment and the distance from a plate in a case where positive ions are generated.
Figure 2B:
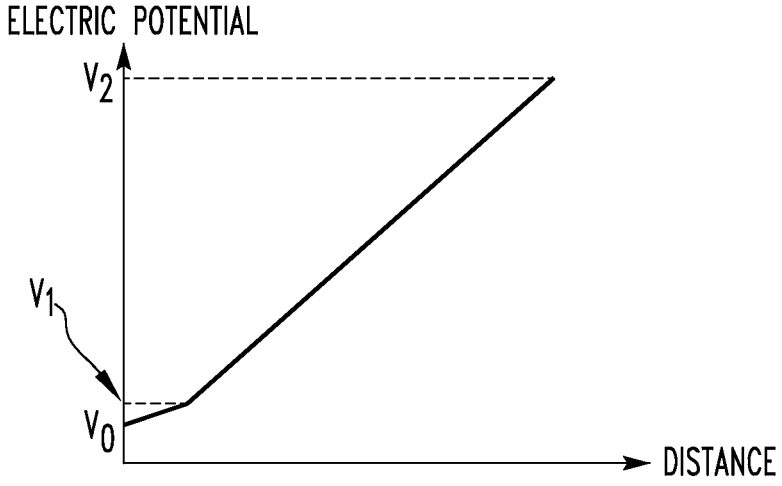
FIG. 2B is a graph similar to FIG. 2A, but in which negative ions are generated.

The voltage control portion 60 controls the voltages applied to the plate 11, extraction electrode 12, accelerating portion terminal electrode 13, Einzel electrode 14, and ground electrode 15. Where positive ions are generated on the plate 11, the voltage control portion 60 sets the voltage $V_0$ applied to the plate 11, the voltage $V_1$ applied to the extraction electrode 12, and the voltage $V_2$ applied to the accelerating portion terminal electrode 13 in the relation $V_0>V_1>V_2$ as shown in FIG. 2A. In the graph of FIG. 2A, the horizontal axis indicates the distance from the plate 11. The vertical axis indicates electric potential. The voltage $V_2$ applied to the accelerating portion terminal electrode 13 is set, for example, at ground potential (0 V). The voltage control portion 60 sets the voltage $V_3$ applied to the Einzel electrode 14 and the voltage $V_4$ applied to the ground electrode 15 such that $V_2<V_3>V_4=0$ V. On the other hand, where negative ions are produced on the plate 11, the voltage control portion 60 sets the voltages $V_0$, $V_1$, and $V_2$ such that $V_0<V_1<V_2$ (e.g., $V_2$ is 0 V) as shown in FIG. 2B. In the graph of FIG. 2B, the horizontal axis indicates the distance from the plate 11. The vertical axis indicates electric potential. The voltage control portion 60 sets the voltages $V_3$ and $V_4$ such that $V_2>V_3<V_4=0$ V, for example.

Various ions generated and accelerated in the ion source 10 pass through the ground electrode 15 and enter the mass analyzer (ion optics) 20 having a free space. The mass analyzer 20 separates the various ions according to flight time corresponding to mass-to-charge ratio in the free space. In particular, the mass analyzer 20 separates the various ions by making use of the fact that the flight time T differs according to mass-to-charge ratio m/z of the ions as given by Eq. (3). The various ions separated by the mass analyzer 20 reach the detector 30.

The detector 30 outputs an analog signal in real time, the signal corresponding to positions of arrival of ions on the detection surface and to the amount of ions (intensity).

The data processing portion 40 analyzes the positions of arrival of ions on the detector 30, arrival times, and intensities, based on the output signal from the detector 30, and generates an image corresponding to information about the results of the analysis. The image generated by the data processing portion 40 is displayed on the display portion 50.

In this way, the detector 30 and data processing portion 40 together constitute a detection system 90 which measures the positions of arrival of the ions and their flight times, and generates an image of the sample at the time of ionization (a magnified image in practice).

In the imaging mass spectrometer 1 configured in this way, the initial stage of lens system 70 contributes to the magnification ratio of the image of the sample when it is ionized. In many cases, the initial stage of lens system 70 contributes most to the magnification ratio. This lens system exhibits a lens effect according to the ratio ($|V_0-V_1|/|V_1-V_2|$) of the absolute value of the difference between the voltage $V_0$ on the plate 11 and the voltage $V_1$ on the extraction electrode 12, i.e., $|V_0-V_1|$, to the absolute value of the difference between the voltage $V_1$ on the extraction electrode 12 and the voltage $V_2$ on the accelerating portion terminal electrode 13, i.e., $|V_1-V_2|$. As the ratio $|V_0-V_1|/|V_1-V_2|$ decreases, the lens effect increases, exerting a greater force on the ions. As a result, the direction of travel is bent. As ions having a greater mass-to-charge ratio have a greater initial kinetic energy when generated on the plate 11. Therefore, if the lens effect of the lens system 70 is made stronger on ions having greater mass-to-charge ratios m/z (i.e., heavier ions), ions can be converged irrespective of mass-to-charge ratio. On the other hand, ions with greater mass-to-charge ratios move away from the plate 11 in longer times. Accordingly, in the present embodiment, the voltage control portion 60 maintains constant the voltage on the plate electrode 11 and sweeps the voltage applied to the extraction electrode 12 such that the lens effect of the lens system 70 becomes stronger with the elapse of time during a given period synchronized with the irradiation of the sample with the laser light. More specifically, the voltage control portion 60 varies the voltage on the extraction electrode 12 such that the ratio $|V_0-V_1|/|V_1-V_2|$ decreases with the elapse of time during the given period.

Figure 3A:
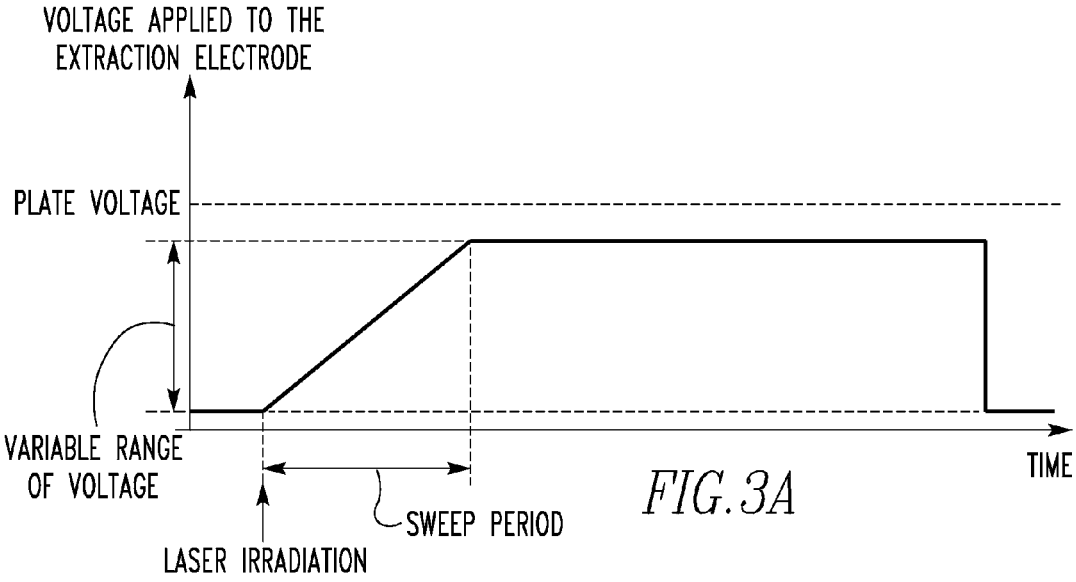
FIG. 3A is a graph showing one example of voltage applied to the extraction electrode according to the first embodiment in a case where positive ions are generated.
Figure 3B:
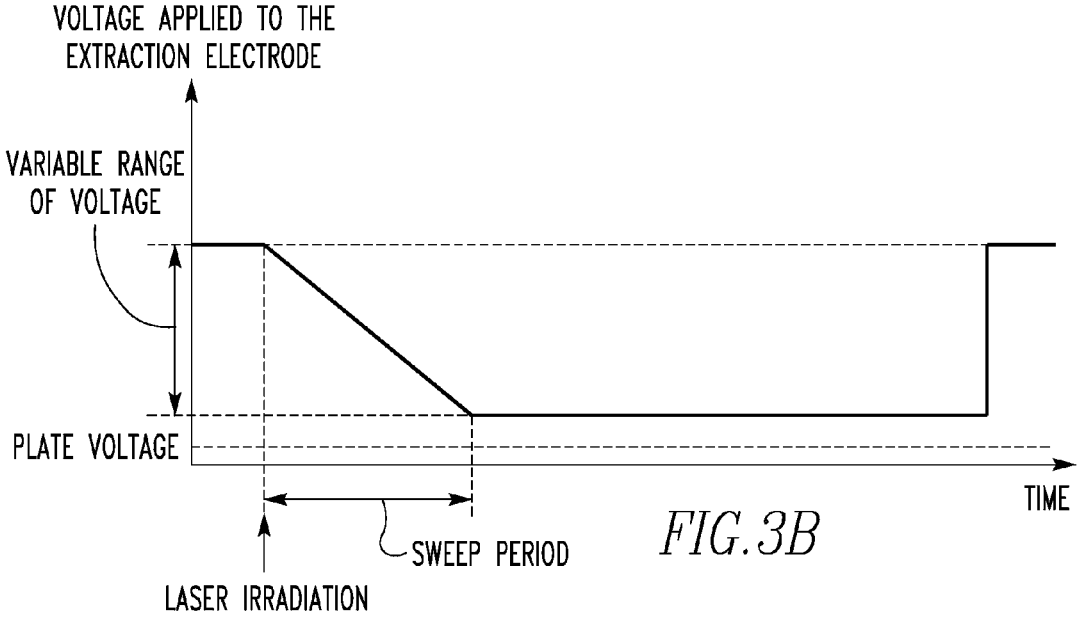
FIG. 3B is a graph similar to FIG. 3A, but in which negative ions are generated.

FIGS. 3A and 3B show examples of the voltage applied to the extraction electrode 12 by the voltage control portion 60. FIG. 3A shows a case in which positive ions are generated on the plate 11. FIG. 3B shows a case in which negative ions are generated on the plate 11. In the graphs of FIGS. 3A and 3B, the horizontal axis indicates time, while the vertical axis indicates the voltage on the extraction electrode 12.

In the example of FIG. 3A, the voltage control portion 60 sets the voltage on the extraction electrode 12 to a minimum value of a variable range of voltage until the sample is irradiated with laser light. The control portion increases the voltage on the extraction electrode 12 during a given period (sweep period) subsequent to the laser irradiation. After a maximum value of the variable range of voltage applied to the extraction electrode 12 is reached, the applied voltage is maintained at this maximum value. After all the ions to be measured this time have passed through the accelerating portion terminal electrode 13, the voltage control portion 60 returns the voltage on the extraction electrode 12 to the minimum value until the sample is irradiated with laser light for a next measurement.

In the example of FIG. 3B, the voltage control portion 60 sets the voltage applied to the extraction electrode 12 to the maximum value of the variable range of voltage until the sample is irradiated with laser light, lowers the voltage on the extraction electrode 12 during the given period (sweep period) after laser irradiation, and maintains the voltage to its minimum value after the voltage on the extraction electrode 12 has reached the minimum value of the variable range of voltage. Then, the voltage control portion 60 increases the voltage on the extraction electrode 12 back to its maximum value until the sample is irradiated with laser light for a next measurement after all the ions to be measured this time pass through the accelerating portion terminal electrode 13.

In both cases of FIGS. 3A and 3B, the ratio $|V_0-V_1|/|V_1-V_2|$ decreases with the elapse of time during the sweep period. That is, the lens effect becomes stronger with time during the sweep period.

Figure 4:
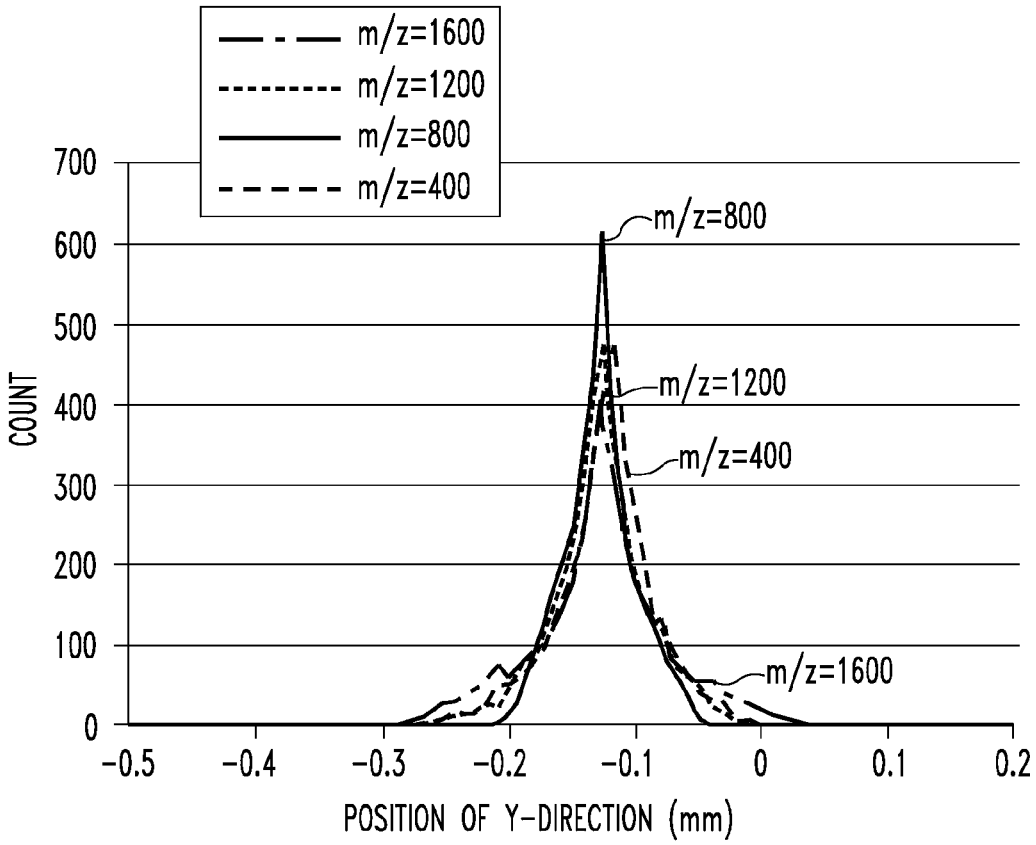
FIG. 4 is a graph showing one example of results of a simulation of an ion trajectory in accordance with the first embodiment.
Figure 9:
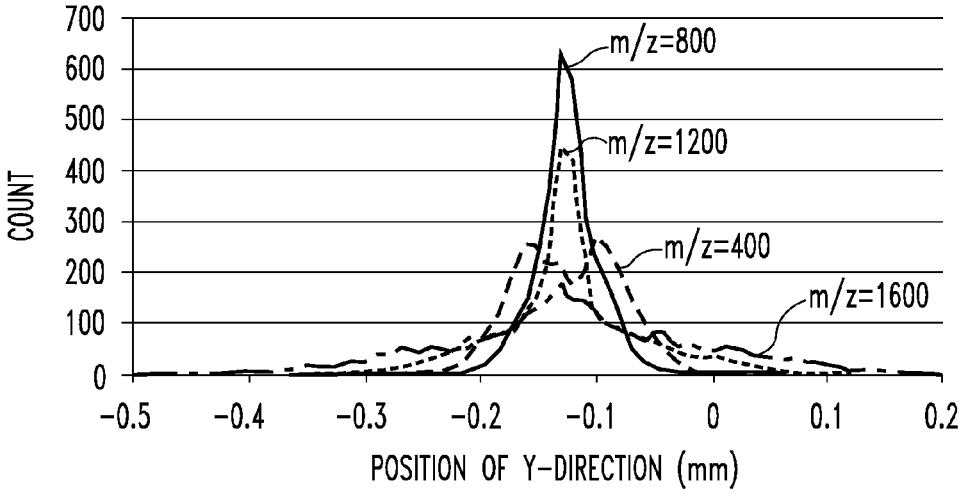
FIG. 9 is a graph showing one example of results of a simulation of an ion trajectory in the conventional stigmatic imaging mass spectrometer.

The configuration of the imaging mass spectrometer 1 of the present embodiment was modeled, and the ion trajectory was simulated under conditions similar to simulation conditions described in connection with FIG. 9 except for the voltage on the extraction electrode 12. In this simulation, the minimum and maximum values of the voltage on the extraction electrode 12 shown in FIG. 3A were 19,365 V and 19,430 V, respectively. The sweep period was set to 200 ns. The results of the simulation are shown in FIG. 4, which shows spatial distributions of ion packets with m/z values of 400, 800, 1200, and 1600, respectively, on the detection surface of the detector 30. As can be seen by comparison of the results shown in FIG. 4 with FIG. 9 showing the results of a simulation done using a conventional technique, high positional resolutions have been successfully created over a wide range of m/z values of ions.

In the present embodiment, the voltage on the extraction electrode 12 is swept simultaneously with irradiation of the sample with laser light. Alternatively, sweeping may be started after a given time since the laser irradiation. The relation between the voltage on the extraction electrode 12 during the sweep period and time is not restricted to linear relationships as shown in FIGS. 3A and 3B. Similar advantageous effects can be obtained using relationships expressed by polynomial equations or exponential functions.

As described so far, according to the imaging mass spectrometer of the first embodiment, ions can be converged uniformly irrespective of their mass-to-charge ratio by sweeping the voltage applied to the extraction electrode 12 such that the lens effect of the lens system 70 becomes stronger with the elapse of time in synchronism with the irradiation of the sample with laser light. This reduces the dependence of the resolution of the projection image on mass. The positional resolution of the detection system 90 is improved over a wide range of mass-to-charge ratios. In consequence, an image of high resolution can be obtained.

2. Second Embodiment

Since the configuration of an imaging mass spectrometer, indicated by numeral 1, according to a second embodiment of the present invention is similar to the imaging mass spectrometer of the first embodiment shown in FIG. 1, the spectrometer is omitted from being shown. However, in the imaging mass spectrometer 1 of the second embodiment, the voltage control portion 60 is different in operation from its counterpart of the first embodiment. The second embodiment is similar in other configurations with the first embodiment and so a description thereof is omitted.

In the first embodiment, the voltage control portion 60 varies only the voltage on the extraction electrode 12 with time. In the second embodiment, the voltage control portion 60 maintains constant the voltage on the extraction electrode 12 and sweeps the voltage applied to the plate 11 such that the lens effect of the lens system 70 becomes stronger with the elapse of time during the given period synchronized with the irradiation of the sample with laser light. Specifically, the voltage control portion 60 varies the voltage on the plate 11 such that the ratio $|V_0-V_1|/|V_1-V_2|$ decreases with time during the given period.

Figure 5A:
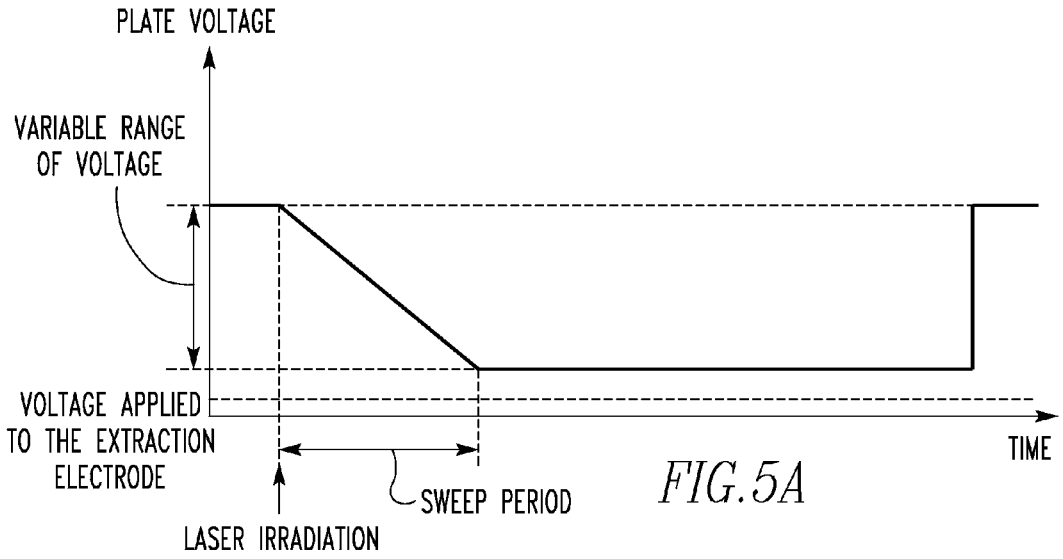
FIG. 5A is a graph showing one example of voltage applied to the extraction electrode according to a second embodiment of the present invention in a case where positive ions are generated.
Figure 5B:
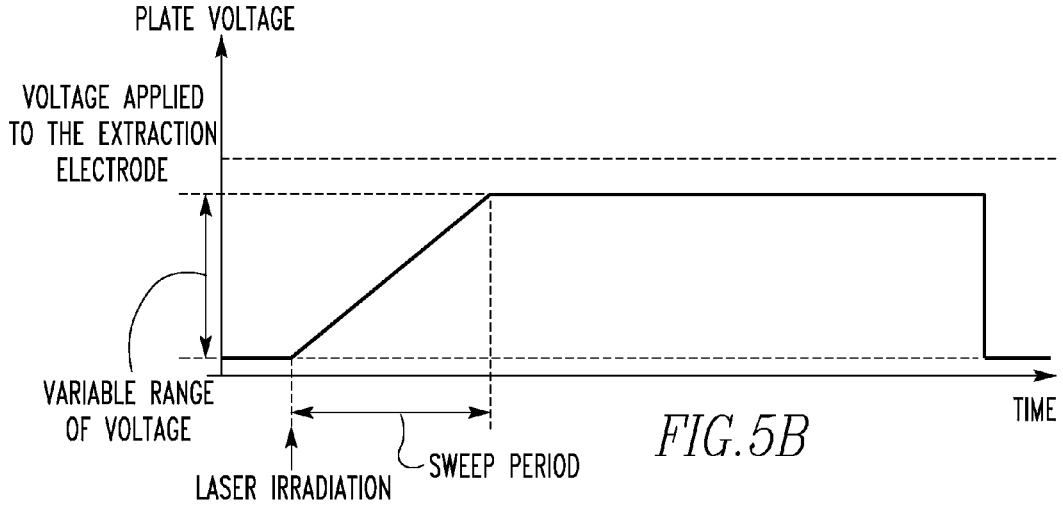
FIG. 5B is a graph similar to FIG. 5A, but in which negative ions are generated.

FIGS. 5A and 5B show examples of the voltage applied to the plate 11 by the voltage control portion 60. In the example of FIG. 5A, positive ions are generated on the plate 11. In the example of FIG. 5B, negative ions are generated on the plate 11. In the graphs of FIGS. 5A and 5B, the horizontal axis indicates time, while the vertical axis indicates the voltage on the plate 11.

In the example of FIG. 5A, the voltage control portion 60 sets the voltage on the plate 11 to the maximum value of the variable range of the voltage until the sample is irradiated with laser light, lowers the voltage on the plate 11 during the given period (sweep period) after the laser irradiation. After the voltage on the plate 11 has reached the minimum value of the variable range of voltage, the control portion maintains the minimum value. Then, the control portion 60 returns the voltage on the plate 11 to the maximum value after all the ions to be measured this time pass through the accelerating portion terminal electrode 13 until the sample is irradiated with laser light for a next measurement.

In the example of FIG. 5B, the voltage control portion 60 sets the voltage on the plate 11 to the minimum value of the variable range of voltage until the sample is irradiated with laser light. During the given period (sweep period) after the laser irradiation, the control portion increases the voltage on the plate 11. After the voltage on the plate 11 has reached the maximum value of the variable range of voltage, the control portion maintains the maximum value. Then, the voltage control portion 60 returns the voltage, on the plate 11 to the minimum value after all the ions to be measured this time pass through the accelerating portion terminal electrode 13 until the sample is irradiated with laser light for a next measurement.

In all the cases of FIGS. 5A and 5B, the ratio $|V_0-V_1|/|V_1-V_2|$ decreases with the elapse of time during the sweep period. That is, the lens effect becomes stronger with time during the sweep period.

In the present embodiment, the voltage on the plate 11 is swept simultaneously with irradiation of the sample with laser light. The sweep may be started after a given time since the laser irradiation. The relation between the voltage on the plate 11 during the sweep period and time is not restricted to linear relationships as shown in FIGS. 5A and 5B. Similar advantageous effects can be obtained using relationships expressed by polynomial equations or exponential functions.

According to the imaging mass spectrometer of the second embodiment described so far, ions can be converged uniformly irrespective of their mass-to-charge ratio by sweeping the voltage applied to the plate 11 such that the lens effect of the lens system 70 becomes stronger with the elapse of time in synchronism with the irradiation of the sample with laser light. Consequently, the dependence of the resolution of the projection image on mass decreases. The positional resolution of the detection system 90 is improved over a wide range of mass-to-charge ratios. An image of high resolution can be obtained.

Alternatively, the voltage control portion 60 may sweep the voltage on the plate 11 and the voltage on the extraction electrode 12 such that the lens effect of the lens system 70 becomes stronger with the elapse of time during the given period synchronized with the irradiation of the sample with laser light.

3. Third Embodiment

Since the configuration of an imaging mass spectrometer, indicated by numeral 1, according to a third embodiment of the present invention is similar to the imaging mass spectrometer of the first embodiment shown in FIG. 1, the spectrometer is omitted from being shown. However, in the imaging mass spectrometer 1 of the third embodiment, the voltage control portion 60 is different in operation from its counterpart of the first embodiment. The third embodiment is similar in other configurations with the first embodiment and so a description thereof is omitted.

In the first embodiment, the voltage control portion 60 maintains constant the sweep period and the variable range of the voltage (range of the swept voltage) applied to the extraction electrode 12. In the third embodiment, the voltage control portion 60 varies the sweep period and the variable range of voltage applied to the extraction electrode 12 according to the setting of the range of mass-to-charge ratios of ions to be measured.

Figure 6A:
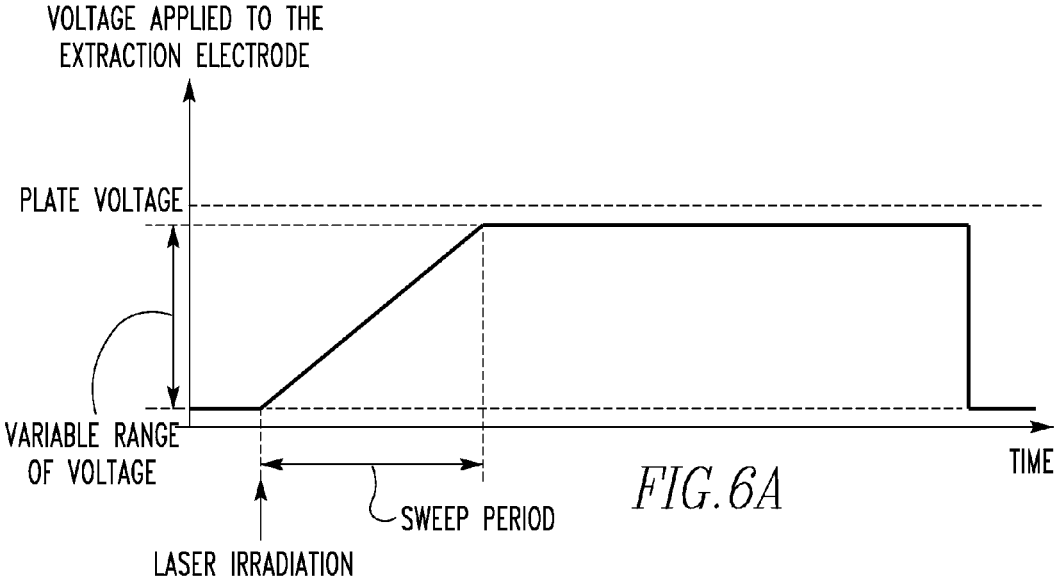
FIG. 6A is a graph showing one example of voltage applied to the extraction electrode in the second embodiment in a case where ions to be measured have a wide range of mass-to-charge ratios.
Figure 6B:
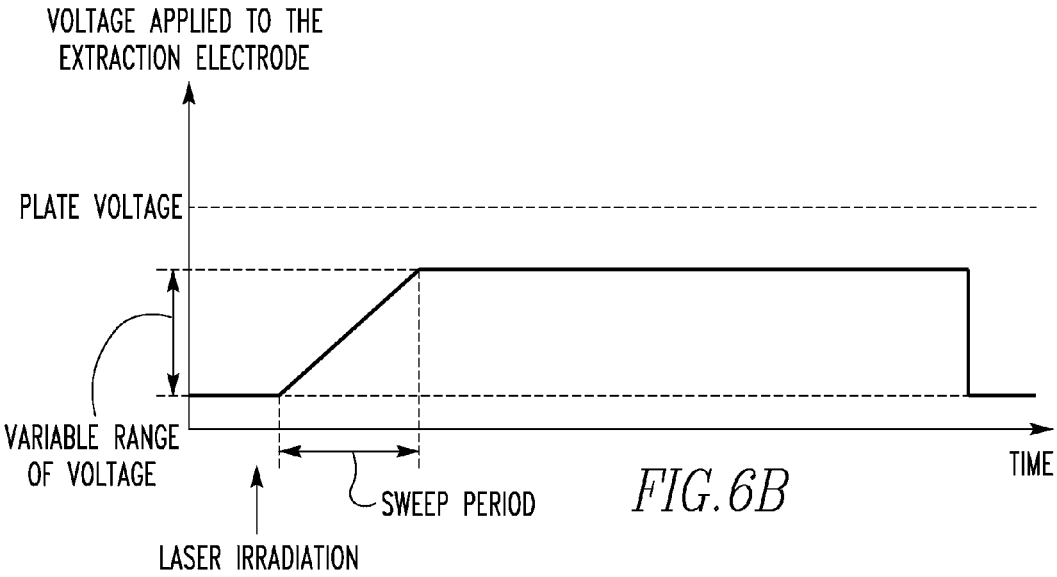
FIG. 6B is a graph similar to FIG. 6A, but in which ions to be measured have a narrow range of mass-to-charge ratios.

FIGS. 6A and 6B show examples of the voltage applied to the extraction electrode 12 by the voltage control portion 60. In both examples of FIGS. 6A and 6B, positive ions are generated on the plate 11. In the example of FIG. 6A, the range of mass-to-charge ratios of ions to be measured is wider than in the case of FIG. 6B. In the example of FIG. 6B, the range of mass-to-charge ratios of ions to be measured is narrower than in the example of FIG. 6A. In the graphs of FIGS. 6A and 6B, the horizontal axis indicates time, while the vertical axis indicates the voltage on the extraction electrode 12.

In the example of FIG. 6A, the voltage control portion 60 starts to sweep the voltage on the extraction electrode 12 simultaneously with the irradiation of the sample with laser light. In contrast, in the example of FIG. 6B, the voltage on the extraction electrode 12 is started to be swept with a delay relative to the irradiation of the sample with laser light. The voltage on the extraction electrode 12 at the beginning of sweep is higher in the case of FIG. 6B. In the case of FIG. 6B, the voltage control portion 60 ends the sweep of the voltage on the extraction electrode 12 earlier than in the case of FIG. 6A. The voltage on the extraction electrode 12 at the end of the sweep is lower in the case of FIG. 6B, for the following reason. The minimum value of the mass-to-charge ratios of the ions to be measured is greater in the case of FIG. 6B and the maximum value of the mass-to-charge ratios of the ions to be measured is smaller in the case of FIG. 6B. In both FIGS. 6A and 6B, the tilt of variation of the voltage on the extraction electrode 12 during the sweep period is the same. The voltage control portion 60 may vary the tilt of variation of the voltage on the extraction electrode 12 in the sweep period according to the range of mass-to-charge ratios of the ions to be measured.

To achieve the processing performed by the voltage control portion 60 as shown in FIGS. 6A and 6B, the corresponding relation, for example, among the mass-to-charge ratios of ions, the optimum voltage value on the extraction electrode 12, and the timing at which the voltage is applied is evaluated. Information about a table defining the corresponding relationship is previously stored in a nonvolatile memory (not shown in FIG. 1). The range of the mass-to-charge ratios of the ions to be measured is set, for example, by a user. The set range of the mass-to-charge ratios (e.g., its minimum and maximum values) is stored in the memory (not shown in FIG. 1). The voltage control portion 60 refers to the table defining the corresponding relationship, and extracts the value of the voltage on the extraction electrode 12 and the timing of application of the voltage for the set minimum value of the mass-to-charge ratios of the ions as well as the value of the voltage on the extraction electrode 12 and the timing of application of the voltage for the set maximum value of the mass-to-charge ratios of the ions. If such a table is not available, they are calculated by a linear interpolation method. The voltage control portion 60 determines the timing at which the voltage on the extraction electrode 12 starts to be swept, the value of the voltage at the start of the sweep, the timing of end of the sweep, and the value of the voltage at the end of the sweep based on the results of the extraction or on the results of calculations, and sweeps the voltage on the extraction electrode 12.

According to the imaging mass spectrometer of the third embodiment described so far, the voltage sweep time for the lens system 70 and the variable range of voltage is varied appropriately according to the range of mass-to-charge ratios of the ions to be measured, because the optimum voltage value of the lens system 70 differs according to the mass-to-charge ratios of ions. Consequently, the positional resolution of the detection system 90 can be improved. As a result, a projection image of high resolution can be obtained.

In the present embodiment, the voltage control portion 60 sweeps the voltage on the extraction electrode 12 and varies the sweep period and the variable range of the voltage. The voltage on the plate 11 may be swept and the sweep period and the variable range of the voltage may be varied as in the second embodiment. Alternatively, both the voltage on the extraction electrode 12 and the voltage on the plate 11 may be swept and their sweep periods and the variable range of voltage may be varied.

4. Fourth Embodiment

Figure 7:
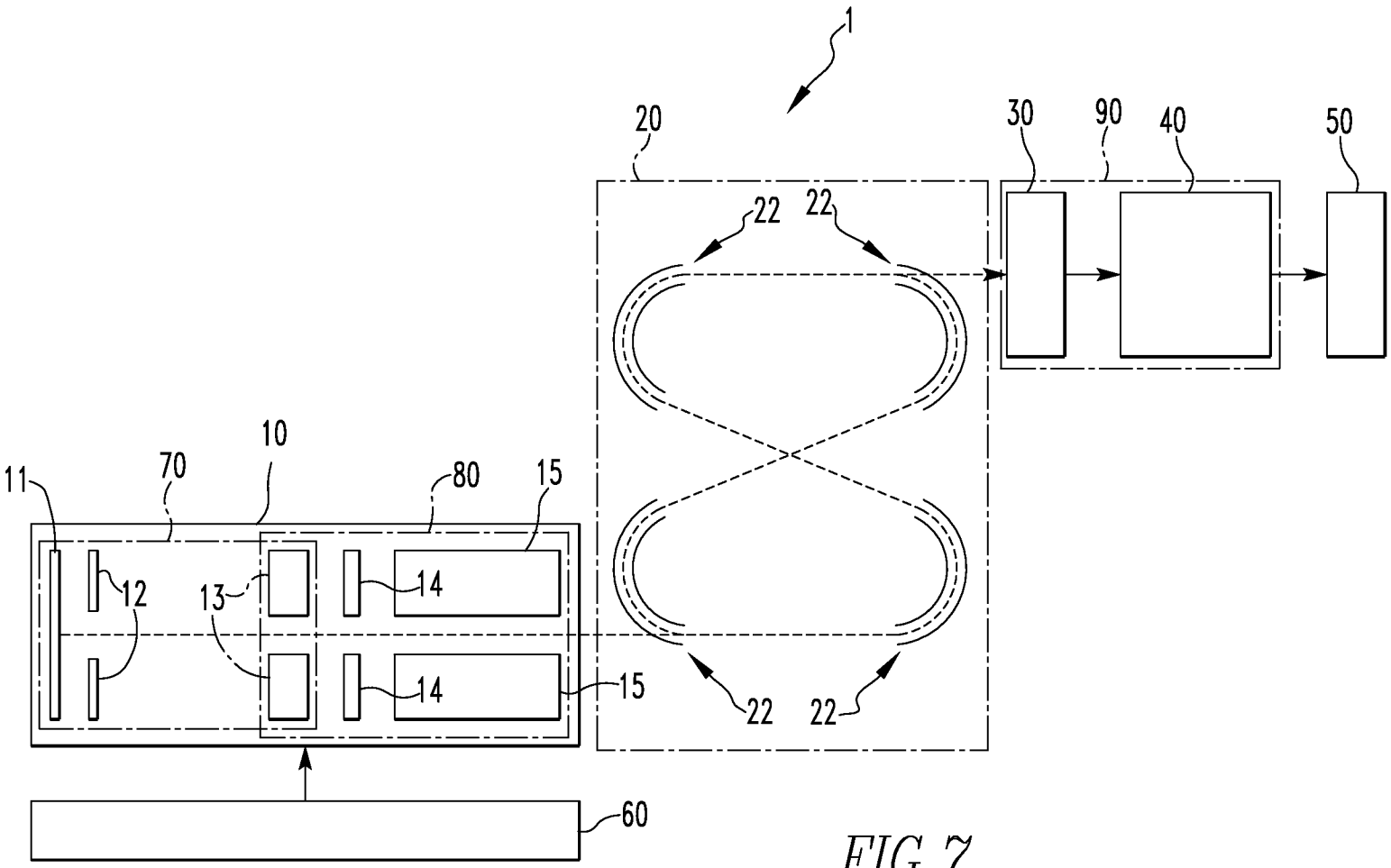
FIG. 7 is a diagram of an imaging mass spectrometer according to a fourth embodiment of the invention, showing one example of configuration of the spectrometer.
Figure 8:
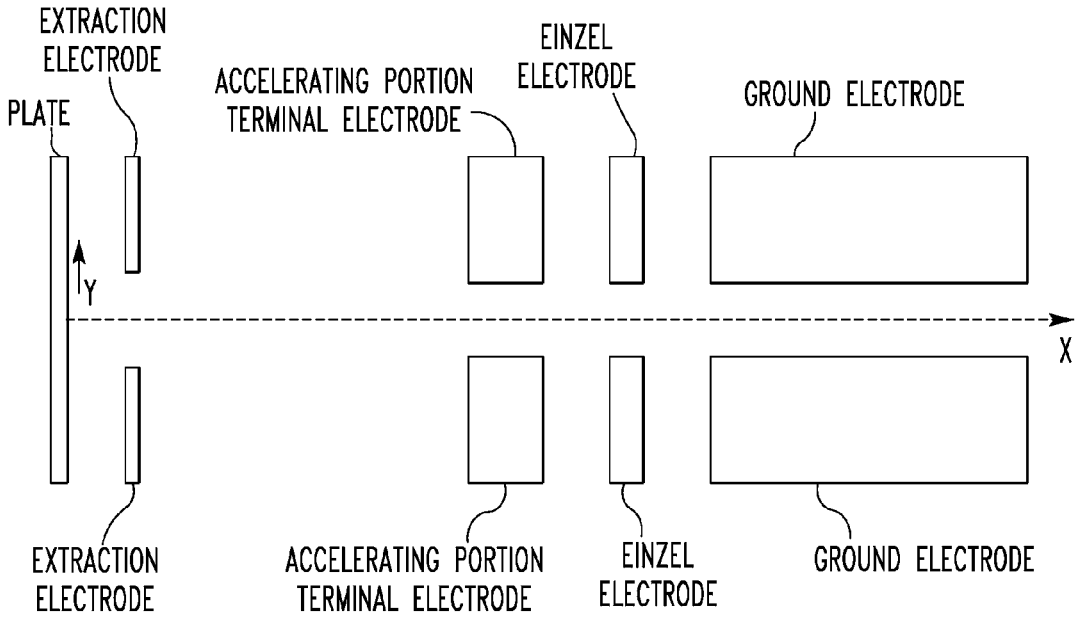
FIG. 8 is a schematic view of the ion accelerating portion (ion source) of a conventional stigmatic imaging mass spectrometer, showing the structure of the ion accelerating portion.

FIG. 7 shows one example of configuration of an imaging mass spectrometer according to the fourth embodiment of the present invention. This imaging mass spectrometer according to the fourth embodiment is generally indicated by reference numeral 1, and is configured including an ion source 10, a mass analyzer 20, a detector 30, a data processing portion 40, a display portion 50, and a voltage control portion 60 in the same way as in the first embodiment described in connection with FIG. 1. Some of these constituent elements of the imaging mass spectrometer of the present embodiment may be omitted or modified. New constituent elements may be added to this mass spectrometer.

The ion source 10, detector 30, data processing portion 40, and display portion 50 are similar in configuration and operation with their counterparts of the first embodiment. The voltage control portion 60 is similar in operation with its counterpart of any one of the first through third embodiments and a description thereof is omitted.

The mass analyzer 20 forms an electric field that makes an ion image obtained whenever ions travel a given distance analogous with the image obtained during ionization. For example, the mass analyzer may be configured including at least one electric sector. One example of such a mass analyzer 20 is a multi-turn mass analyzer in which four cylindrical sectorial electrodes 22 each producing a sectorial electric field are arranged in desired positions as shown in FIG. 7 and in which ions exiting from the ion source make multiple revolutions while passing through the internal spaces of the four sectorial electrodes 22. By designing the mass analyzer 20 as a multi-turn type, ions with different mass-to-charge ratios can be made to travel in more greatly different flight times without varying the ion image when ions enter the mass analyzer 20 or the ion image when the ions exit from the mass analyzer 20. Accordingly, by designing the mass analyzer 20 as a multi-turn type, the time resolution (mass resolution) of the detection system 90 can be improved without distorting the image projected onto the display portion 50.

According to the imaging mass spectrometer of the fourth embodiment described so far, the positional resolution of the detection system 90 can be improved over a wide range of mass-to-charge ratios in the same way as in the first or second embodiment. The time resolution (mass resolution) of the detection system 90 can also be improved by lengthening the flight times of ions. Consequently, an image of high resolution and reliability can be derived. The present invention is not restricted to the present embodiment but rather may be variously modified in implementing the embodiment within the scope of the present invention.

It is to be understood that the above-described embodiments are merely exemplary and that the invention is not restricted to them. For example, the embodiments may be combined appropriately.

The present invention embraces configurations substantially identical (e.g., in function, method, and results or in purpose and advantageous effects) with the configurations described in the preferred embodiments of the invention. Furthermore, the invention embraces the configurations described in the embodiments including portions which have replaced non-essential portions. In addition, the invention embraces configurations which produce the same advantageous effects as those produced by the configurations described in the preferred embodiments or which can achieve the same objects as the objects of the configurations described in the preferred embodiments. Further, the invention embraces configurations which are the same as the configurations described in the preferred embodiments and to which well-known techniques have been added.

What is claimed is:

1. An imaging mass spectrometer comprising:

an initial stage lens system comprising a plate on which a sample is placed, an extraction electrode for extracting ions generated by irradiating the sample with laser light, and a terminal electrode;

an acceleration stage lens system having an electrode for accelerating the ions extracted from the sample in the initial stage lens system;

an ion optical system for separating the ions according to flight time corresponding to mass-to-charge ratio;

a detection system for measuring arrival positions and flight times of the ions passed through the ion optical system and generating an image of the sample when it is ionized; and a voltage control portion for sweeping the voltage applied to the plate or the extraction electrode such that the lens effect of the initial stage lens system contributing to the magnification ratio of the image increases with the elapse of time during a given period synchronized with the laser irradiation.

2. An imaging mass spectrometer as set forth in claim 1, wherein said voltage control portion maintains constant the voltage applied to the plate and sweeps the voltage applied to the extraction electrode during the given period.

3. An imaging mass spectrometer as set forth in claim 1, wherein said voltage control portion maintains constant the voltage applied to the extraction electrode and sweeps the voltage applied to the plate during the given period.

4. An imaging mass spectrometer as set forth in claim 1, wherein said voltage control portion sweeps both the voltage applied to the plate and the voltage applied to the extraction electrode during the given period.

5. An imaging mass spectrometer as set forth in claim 1, wherein said voltage control portion sweeps at least one of the applied voltages such that the ratio $|V_0-V_1|/|V_1-V_2|$ decreases with the elapse of time during the given period, where $V_0$ is the voltage on the plate, $V_1$ is the voltage on the extraction electrode, and $V_2$ is the voltage on the accelerating stage terminal electrode.

6. An imaging mass spectrometer as set forth in claim 1, wherein said voltage control portion varies the given period and the range of the swept voltage according to a setting of the range of mass-to-charge ratios of the ions to be measured.

7. An imaging mass spectrometer as set forth in claim 1, wherein said ions are generated by mixing a matrix for promoting ionization of the sample in the sample to thereby form a mixture, dripping the mixture onto the plate, and irradiating the drips of the mixture with the laser light.

8. An imaging mass spectrometer as set forth in claim 1, wherein said plate has a nanostructured layer for promoting ionization of the sample, and wherein said ions are generated by dripping the sample onto the nanostructured layer of the plate and irradiating the drips of the sample with the laser light.

9. An imaging mass spectrometer as set forth in claim 1, wherein said ion optical system forms an electric field that makes an image obtained whenever the ions travel a given distance analogous with the image produced when the ions are generated.

10. An imaging mass spectrometer as set forth in claim 9, wherein said ion optical system contains at least one electric sector.

11. A method of controlling an imaging mass spectrometer having: a plate on which a sample is placed; at least one lens system comprising said plate and an extraction electrode through which ions generated by irradiating the sample with laser light pass; an ion optical system for separating the ions according to flight time corresponding to mass-to-charge ratio; and a detection system for measuring arrival positions and flight times of the ions passed through the ion optical system and generating an image of the sample when it is ionized; said method comprising the step of:

sweeping the voltage applied to said plate or extraction electrode included in the lens system such that the lens effect of the lens system contributing to the magnification ratio of the image increases with the elapse of time during a given period synchronized with the laser irradiation.

* * * * *